US010012189B2

(12) United States Patent
Kondo et al.

(10) Patent No.: US 10,012,189 B2
(45) Date of Patent: Jul. 3, 2018

(54) IN TANK FUEL PUMP MOUNTING ARRANGEMENT

(71) Applicant: AISAN KOGYO KABUSHIKI KAISHA, Obu-shi, Aichi-ken (JP)

(72) Inventors: Takayuki Kondo, Inazawa (JP); Koji Yoshida, Kasugai (JP); Tatsuki Fukui, Nagoya (JP); Shinya Higashi, Kasugai (JP); Takuya Kono, Nagoya (JP); Yuichi Murakoshi, Inazawa (JP); Akihiro Yano, Obu (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 29 days.

(21) Appl. No.: 15/506,291

(22) PCT Filed: Aug. 10, 2015

(86) PCT No.: PCT/JP2015/072658
§ 371 (c)(1),
(2) Date: Feb. 24, 2017

(87) PCT Pub. No.: WO2016/031544
PCT Pub. Date: Mar. 3, 2016

(65) Prior Publication Data

US 2017/0276105 A1 Sep. 28, 2017

(30) Foreign Application Priority Data

Aug. 26, 2014 (JP) ..... 2014-171444

(51) Int. Cl.
*F02M 37/10* (2006.01)
*F02M 37/00* (2006.01)

(52) U.S. Cl.
CPC ..... *F02M 37/103* (2013.01); *F02M 37/0017* (2013.01); *F02M 37/10* (2013.01); *F02M 37/00* (2013.01)

(58) Field of Classification Search
CPC ..... F02M 37/10; F02M 37/103
(Continued)

(56) References Cited

U.S. PATENT DOCUMENTS 5,522,425 A * 6/1996 Kroiss ..... F02M 37/106 123/514
6,000,913 A 12/1999 Chung et al.
(Continued)

FOREIGN PATENT DOCUMENTS

JP H11-264353 A 9/1999
JP H11-264355 A 9/1999
(Continued)

OTHER PUBLICATIONS

Japanese Patent Application No. 2014-171444 Notification of Reasons for Refusal dated Jun. 20, 2017 (6 pages).
(Continued)

*Primary Examiner* — Erick Solis
(74) *Attorney, Agent, or Firm* — Conley Rose, P.C.

(57) ABSTRACT

A fuel supply device includes a cover member attached to an opening of a fuel tank, a pump unit including a pump, and a connecting portion which connects the cover member and the pump unit. The pump unit is connected so as to be relatively movable with respect to the connecting portion when a connecting shaft which is formed as part of one of the connecting portion or the pump unit, is inserted into the connecting hole formed as part of the other of the two. The connecting hole has an elongated hole portion that allows the connecting shaft to move in the upward and downward directions, and allows the pump unit to be relatively mov-
(Continued)

able with respect to the connecting portion. The pump unit includes an engagement portion abutting a lower terminal end of the connecting portion when the fuel supply device is attached to the fuel tank.

12 Claims, 5 Drawing Sheets

(58) Field of Classification Search
USPC ..... 123/497, 509
See application file for complete search history.

(56) References Cited

U.S. PATENT DOCUMENTS 6,014,957 A * 1/2000 Robinson ..... F02M 37/10 123/509
6,401,751 B2 6/2002 Murakoshi et al.
6,716,000 B2 4/2004 Appleton et al.
6,752,129 B2 * 6/2004 Isozaki ..... F02M 37/103 123/509
7,418,950 B2 * 9/2008 Teets ..... F02M 37/04 123/509
8,424,565 B2 * 4/2013 Solorio ..... B60K 15/03 123/509
9,752,543 B2 * 9/2017 Ikeya ..... F02M 37/0047

FOREIGN PATENT DOCUMENTS

JP 11-324843 A 11/1999
JP 2003-521631 A 7/2003
JP 2006-009729 A 1/2006
JP 2012-184760 A 9/2012

OTHER PUBLICATIONS

International Patent Application No. PCT/JP2015/072658 International Search Report dated Nov. 10, 2015 (5 pages).

* cited by examiner

IN TANK FUEL PUMP MOUNTING ARRANGEMENT

CROSS-REFERENCE TO RELATED APPLICATIONS

The present application is a National Phase entry of, and claims priority to, PCT Application No. PCT/JP2015/072658, filed Aug. 10, 2015, which claims priority to Japanese Patent Application No. 2014-171444, filed Aug. 26, 2014, both of which are incorporated by reference herein in their entireties for all purposes.

STATEMENT REGARDING FEDERALLY SPONSORED RESEARCH OR DEVELOPMENT

Not applicable.

BACKGROUND

The present disclosure relates to a fuel supply device. In particular, the disclosure relates to a fuel supply device for supplying fuel within a fuel tank to an internal combustion engine, wherein the fuel supply device is mounted to a vehicle, e.g. an automobile.

Fuel supply devices mounted to fuel tanks are widely known in the art. It is also widely known that a part of the fuel supply device can be inserted from an opening formed in an upper surface portion of the fuel tank, where the device attaches to said opening when the fuel supply device is mounted to the fuel tank. Further, as disclosed in a Japanese Laid-Open Patent Publication No. 2012-184760 (hereinafter referred to as 760 Publication), a pump unit rotatably provided to a fuel supply device is also known.

BRIEF SUMMARY

However, the prior art disclosed in 760 Publication can still be further improved. According to the fuel supply device disclosed in the 760 Publication, a pump unit may be rotatably mounted to the connecting portion when a connecting shaft provided as part of the pump unit is inserted through a connecting hole. The prior art was not configured such that the force transmitted from the connecting portion presses the pump unit to the fuel tank. Therefore, it could not maintain a state in which the pump unit abuts the fuel tank. Particularly, the prior art could not maintain a state in which the pump unit abuts the fuel tank when a tank bottom surface is inclined as the fuel tank was deformed. As a result, the fuel within the fuel tank could not be used effectively.

Therefore, there is a need for a fuel supply device configured to maintain a pump unit provided as part of the fuel supply device to abut a fuel tank even if the bottom surface of the fuel tank is deformed to be inclined while the fuel supply device is mounted to said fuel tank.

According to one aspect of the present disclosure, a fuel supply device comprises a cover member which is attached to an opening of a fuel tank as well as a pump unit having a pump, and a connecting portion connecting the cover member and the pump unit. The pump unit is connected so as to be relatively movable with respect to the connecting portion when a connecting shaft which is formed as part of one of the connecting portion or the pump unit, is inserted into a connecting hole which is formed as part of the other of the two. The connecting hole has an elongated hole portion that allows the connecting shaft to be relatively movable in the upward and/or downward directions relative to the connecting hole. An engagement portion is provided at the pump unit abutting an end (e.g. a lower end) of the connecting portion when the fuel supply device is attached to the fuel tank.

Therefore, through the abutment, the engagement portion provided at the pump unit can always receive a pressing force from the connecting portion when the fuel supply device is mounted to the fuel tank. Further, since the connecting hole is formed as an elongated hole, a movable range of the connecting shaft is larger than that known in conventional art. Thus, through the expanded range, the flexibility of the relative positional relationship between the connecting portion and the pump unit is increased, and the pump unit can be pressed against the fuel tank by the connecting portion. In this manner, the pump unit can be pressed against the fuel tank even when the fuel tank is deformed to be inclined to follow to the deformation of the fuel tank.

According to another aspect of the present disclosure, the end (e.g. lower end) of the connecting portion has a planar part which can abut the engagement portion, as well as an arcuate curved surface as seen from a side view, which extends from the planar part.

Therefore, the engagement portion can be pressed by the planar portion when the fuel tank is not deformed. The engagement portion can be pressed by the curved surface when the fuel tank is deformed to be inclined. Consequently, through said planar and arcuate parts at its lower end, the connection portion can press the engagement portion with relatively good followability to the deformation of the fuel tank.

According to another aspect of the present disclosure, a fuel supply device comprises a cover member which is attached to an opening of a fuel tank, as well as a pump unit comprising a pump, and a connecting portion for connecting the cover member and the pump unit. The pump unit is connected so as to be relatively movable with respect to the connecting portion when a connecting shaft which is formed as part of one of the connecting portion or the pump unit, is inserted into the connecting hole which is formed in the other of the two. An engagement portion is provided as part of the pump unit, where the engagement portion abuts an end (e.g. lower end) of the connecting portion when the fuel supply device is attached to the fuel tank. The end (e.g. lower end) of the connecting portion has a circular arc curved surface positioned directly below the connecting shaft.

Accordingly, the engagement portion can be pressed by one part of the curved surface of the lower end of the connecting portion when the fuel tank is not deformed, and can be pressed by the other part of the curved surface when the fuel tank is deformed to be inclined. Consequently, through said pressing, the end of the connection portion can press the engagement portion with relatively good followability to the deformation of the fuel tank.

DETAILED DESCRIPTION

Figure 1:
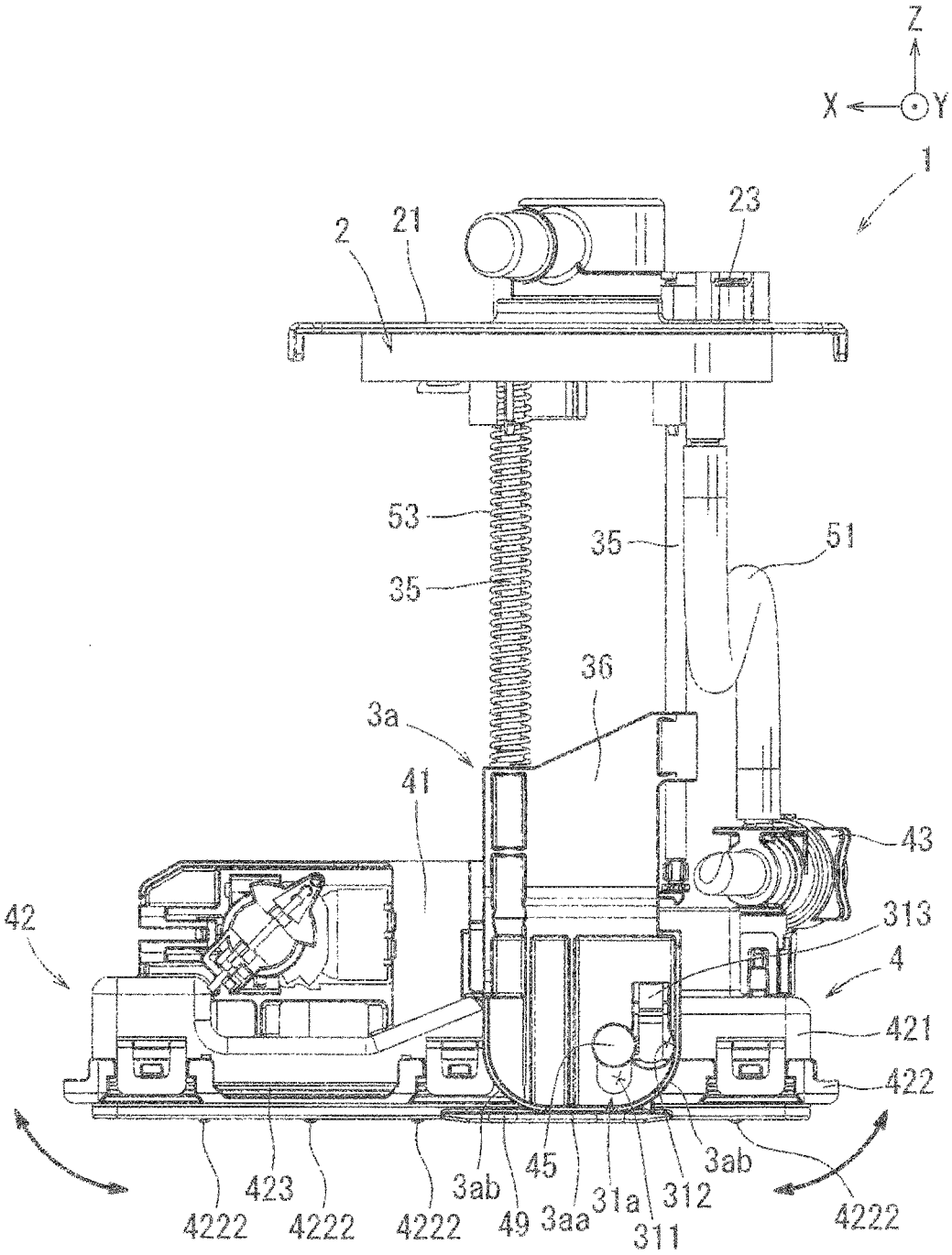
FIG. 1 is a left side view of a fuel supply device according to one embodiment of the present disclosure.

Hereinafter, one exemplary embodiment of the present disclosure will now be described with reference to the drawings. The forward and backward directions, upward and downward directions as well as the leftward and rightward directions in the present specification are determined such that X is a forward direction, Y is a leftward direction and Z is an upward direction as shown in FIG. 1, where the backwards, leftwards, and downwards directions extend in the negative direction of X, Y, and Z, respectively. A cover member 2 of a fuel supply device 1 is positioned at an upper side and a pump unit 4 is positioned at a lower side of the device. A rotary axis of the pump unit 4 extends in the leftward-to-rightward direction, parallel to the y axis. The forward and backward directions are orthogonal to the leftward and rightward directions as well as the upward and downward directions.

The fuel supply device 1 according to the present embodiment may be mounted on a vehicle, such as an automobile. The fuel supply device 1 may be attached to a fuel tank 7 arranged below a floor of the vehicle. The fuel supply device 1 is used to feed liquid fuel stored within the fuel tank 7 to an internal combustion engine (not shown).

Figure 2:
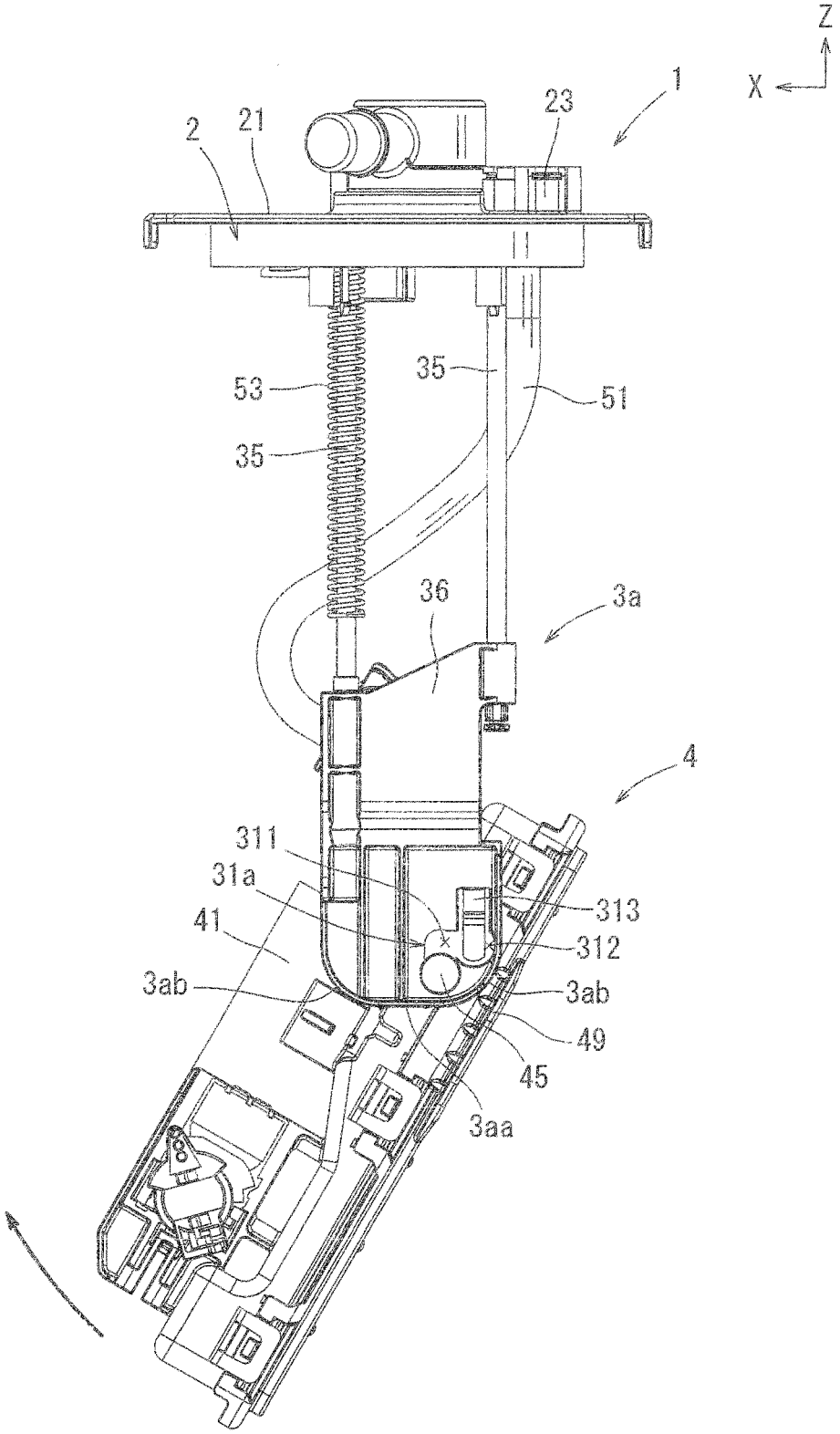
FIG. 2 is a side view of the fuel supply device of FIG. 1 being lifted up while a cover member is held.
Figure 3:
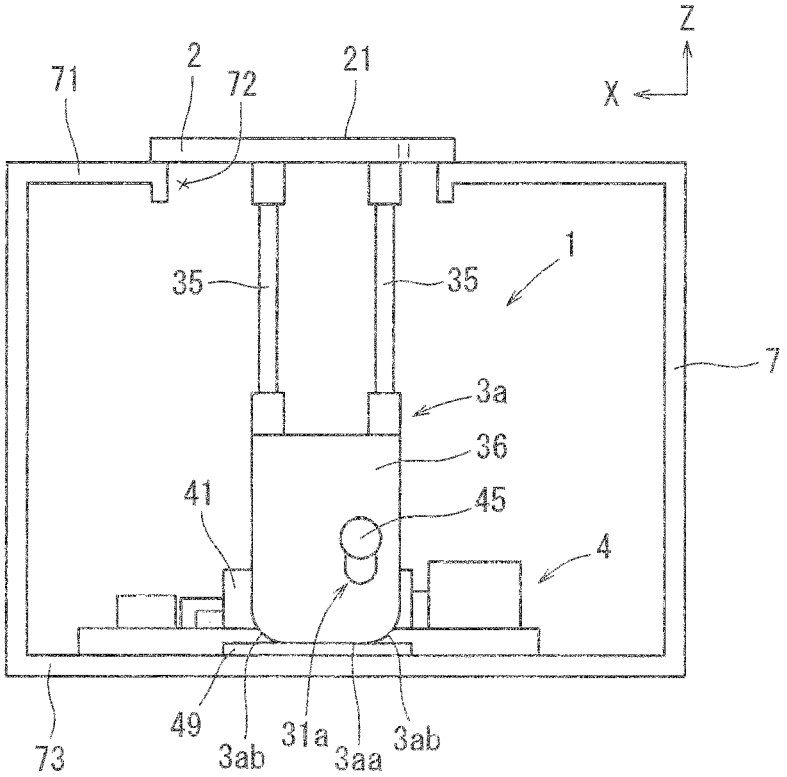
FIG. 3 is a schematic side view showing the fuel supply device of FIG. 1 being attached to a not-deformed fuel tank.

As shown in FIGS. 1 to 3, the fuel supply device 1 according to the present embodiment has the cover member 2 attached to an opening 72 formed within an upper surface 71 of the fuel tank 7 and a pump unit 4 with a pump 41 which may be used for feeding fuel within the fuel tank 7 to the outside. Further, the fuel supply device 1 includes a connecting portion 3*a* used for connecting the cover member 2 to the pump unit 4. When the fuel device is attached to the fuel tank, the pump unit 4 lies proximal to the bottom surface 73 of the fuel tank 7 whereas the cover member 2 is attached to the opening 72 of the fuel tank 7. The cover member 2 can close the opening 72 of the fuel tank 7 and press the pump unit 4 along the bottom surface 73 of the fuel tank 7.

The cover member 2 includes a set plate portion 21 which covers the opening 72 of the fuel tank 7. An outlet port 23 is provided on the substantially disk-shaped set plate portion 21 for leading fuel delivered from the pump unit 4 to the outside of the fuel tank 7. Further, the set plate portion 21 includes an electric connector 24 (not shown) for connecting electric wiring. The opening 72 normally has a circular shape, and the set plate portion 21 has a substantially circular shape in a plan view, which is concentric with and thus corresponds to the shape of the opening 72. A ring made of resin (not shown) is attached to the opening 72 and acts as a sealing member, filling a clearance between the fuel tank 7 and the cover member 2 in order to reduce or eliminate the clearance.

As shown in FIGS. 1 and 2, the pump unit 4 is arranged below the cover member 2. The pump unit 4 includes the pump 41 used for feeding fuel and a base portion 42 used for mounting the pump 41. The base portion 42 has a substantially flat plate shape and is arranged so that one surface of the base portion 42 faces the bottom surface 73 of the fuel tank 7. The base portion 42 may also be referred to as a fuel reservoir or a sub-tank etc. The base portion 42 includes an upper base 421 to which the pump 41 is attached, a lower base 422 which faces and contacts the bottom surface 73 of the fuel tank 7, and a filter member 423 which is interleaved between the upper base 421 and the lower base 422. The upper base 421 is provided with a suction port (not shown) to be connected with the pump 41 and configured such that the fuel passed through the filter member 423 can be sucked by the pump 41.

An outer periphery of the upper base 421 is of a similar shape but smaller than an outer periphery of the lower base 422. A clearance space is formed between the upper base 421 and the lower base 422 when the filter member 423 is not interleaved. The clearance space can serve to introduce fuel into the base portion 42. In this embodiment, thus, instead of interleaving, one surface of the upper base 421 is arranged so as to be covered by the filter member 423. As a result, the fuel entering from the unoccupied clearance into the base portion 42 also reaches the pump 41 through the filter member 423.

A pressure control valve 43 is attached to the pump unit 4 that is used for controlling liquid feed pressure of the fuel. The pressure control valve 43 is attached to a valve supporting portion (not shown) extending from the pump 41. The fuel with adjusted pressure by the pressure control valve 43 is fed to the internal combustion engine, for example, via a hose 51 and the outlet port 23.

As shown in FIG. 1, the connecting portion 3*a* and the pump unit 4 are connected by the connecting shaft 45 which is provided as part of the pump unit 4, and is inserted into the connecting hole 31*a* which is provided at the connecting portion 3*a*. Consequently, referring to the directional arrows shown in FIG. 1 and FIG. 2, the connecting portion 3*a* and the pump unit 4 are connected via the connecting shaft 45 so as to be rotatably movable relative to each other.

Referring to FIGS. 1 and 3, an engagement portion 49 is provided at the lower base 422 of the base portion 42. The engagement portion 49 can engage with the lower end of connecting portion 3*a* such that the pump unit 4 can be maintained in an abutted state where it abuts the bottom surface 73 of the fuel tank 7 when the connecting portion 3*a* through its lower end applies a pressing force to the engagement portion 49.

Referring to FIGS. 1 and 3, the engagement portion 49 is configured to have a substantially flat plate shape in a plane parallel to the XY plane, with a bottom surface arranged on the same plane as the leading ends of the leg portions 4222 which are provided extending downwards from the lower base 422. A top surface, which can abut the lower end of the connecting portion 3*a*, is formed on the vertically opposite side of said bottom surface. The connecting portion 3*a* is maintained abutting the engagement portion's top surface by shortening the distance between the cover member 2 and the pump unit 4 through pressing the cover member 2, which results on downwards force being applied to connecting portion 3*a*. At this time, a spring 53 arranged between the cover member 2 and a part of the connecting portion 3*a* is compressed and a restoring force in a downwards direction of the spring 53 for attempting to return into its original shape is transmitted to the bottom surface 73 of the fuel tank 7 via the lower end of the connecting portion 3*a* and then the engagement portion 49. Consequently, in this manner, the engagement portion 49 is maintained in a pressed state against the bottom surface 73 of the fuel tank 7.

The connecting portion 3*a* shown in FIGS. 1 to 3 is telescopic, and can be extended and retracted. The connecting portion 3*a* includes rod members 35 attached to the cover member 2 and a joint portion 36 which is movable along the length of rod members 35. The rod members 35 extend in a direction orthogonal to the plane in which the set plate portion 21 radially extends, parallel to the XY plane. Further, as mentioned, the spring 53 that can exert elastic force, is arranged between the joint portion 36 and the cover member 2. The spring 53 biases the cover member 2 to move away from the pump unit 4 whenever the cover member 2 and the pump unit 4 mutually approach closer than a predetermined distance. In this manner, the spring member 53 is compressed whenever the cover member 2 is moved towards the bottom surface portion 73 of the fuel tank 7 from an existing state in which the bottom surface of the pump unit 4 is already touching the bottom surface portion 73 of the fuel tank 7. As long as this compressed state of the spring 53 is maintained, the corresponding pressed state of the pump unit 4 against the bottom surface 73 will also be maintained. In particular, biasing force from the compression of the spring 53 is transmitted downward from the connecting portion 3*a* to a connected engagement portion 49 which is provided at the pump unit 4 to press the engagement portion 49 against the bottom surface 73 of the fuel tank 7.

Referring to FIG. 1, the connecting hole 31*a* is configured to have a vertically elongated hole that allows the connecting shaft 45 and the rotation axis it comprises in the direction orthogonal to the XZ plane to be relatively movable in upward and downward directions. More specifically, the connecting hole 31*a* is formed such that the connecting shaft 45 can move vertically in the XZ plane, in a direction substantially orthogonal to a plane in which the set plate portion 21 radially extends (a plane parallel to the XY plane extending in forward and backward as well as leftward and right ward directions). The connecting hole 31*a* includes a slide hole portion 311 in which the connecting shaft 45 can freely slide vertically. The connecting shaft 45 has a main body portion inserted in the slide hole portion 311 and a leading end at its leftmost terminal portion having a larger radius than that of the main body portion. The connecting hole 31*a* has a connecting shaft insertion portion 312 to allow the leading end of the connecting shaft 45 to be inserted. The slide hole portion 311 and the connecting shaft insertion portion 312 of the connecting hole 31*a* are continuously formed. The slide hole portion 311 of the connecting hole 31*a* is a vertically elongated hole, which is elongated in the upward and downward directions where the slide hole portion 311 allows the movement of the connecting shaft 45 in said upward and downward directions.

An engagement piece 313 is provided within the connecting shaft insertion portion 312. The engagement piece 313 is elastically deformed when pressed from one direction but is not deformed when pressed from a direction orthogonal to the said direction. Therefore, it can prevent the connecting shaft 45, when connecting shaft 45 is inserted into the connecting hole 31*a*, from easily being removed from the connecting hole 31*a*.

Figure 6:
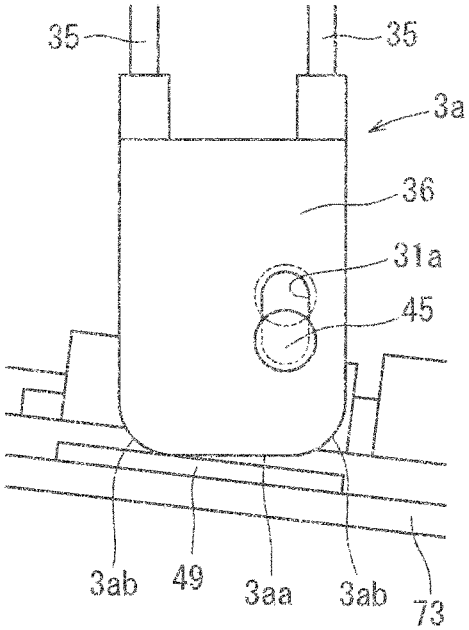
FIG. 6 is a view showing a change in a relative positional relationship of the connecting hole and a connecting shaft due to the deformation of the fuel tank.
Figure 7:
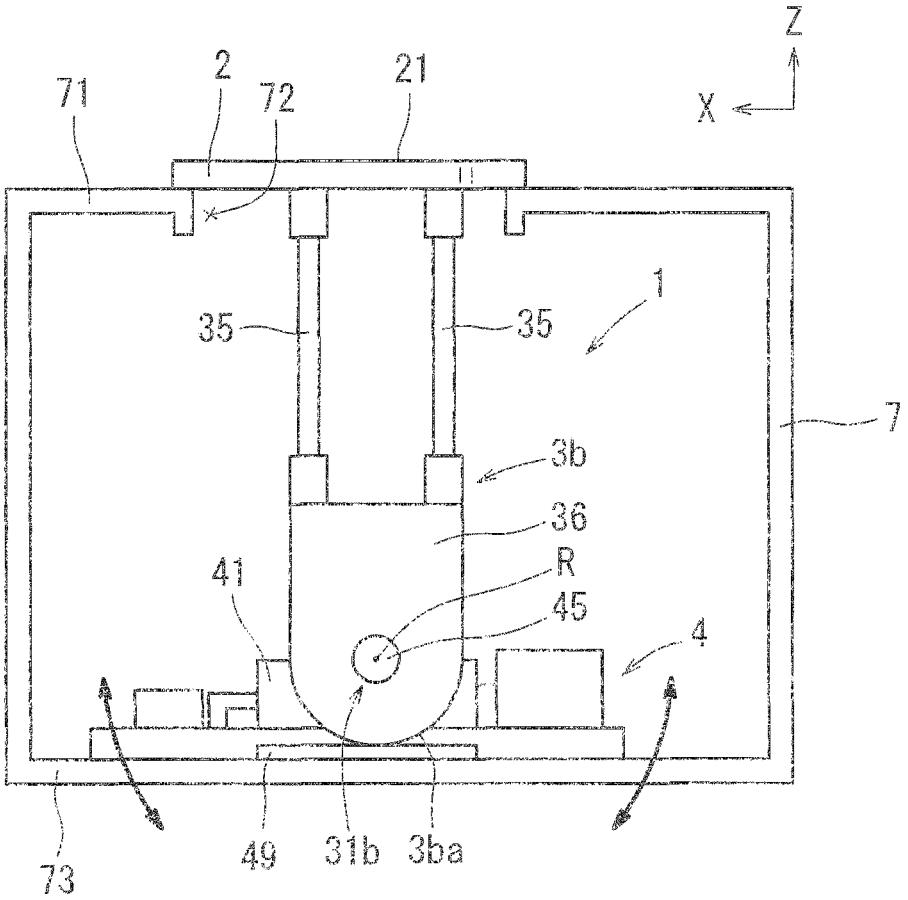
FIG. 7 is a left side view of a fuel supply device according to another embodiment.

The connecting shaft 45 can move in upward and downward directions since through the vertically elongated hole shape of the connecting hole 31*a*. Therefore, it is possible to maintain the lower end of the connecting portion 3*a* and the engagement portion 49 in an abutted state relative to each other even when the pump unit 4 is rotated about the leftward-to-rightward rotary axis of shaft 45 resulting in the pump unit being inclined, as indicated by the directional arrows shown in FIG. 1. Further, the lower end of the connecting portion 3*a* and the engagement portion 49 can be maintained in an abutted state not only if the connecting hole 31*b* configured to have an elongated shape, but they can also abut each other if an end of the connecting portion 3*b* is configured in a circular arc shape as shown in FIG. 7. However, if the connecting hole 31*b* is configured to have an elongated shape, according to the configurations in embodiments shown in FIGS. 1 to 6, the flexibility of the shape at the lower end of the connecting portion 3*a* is then increased, because with the elongated hole 31*b*, it is then not necessary to configure the end of the connecting portion 3*a* to have a circular arc shape.

Figure 4:
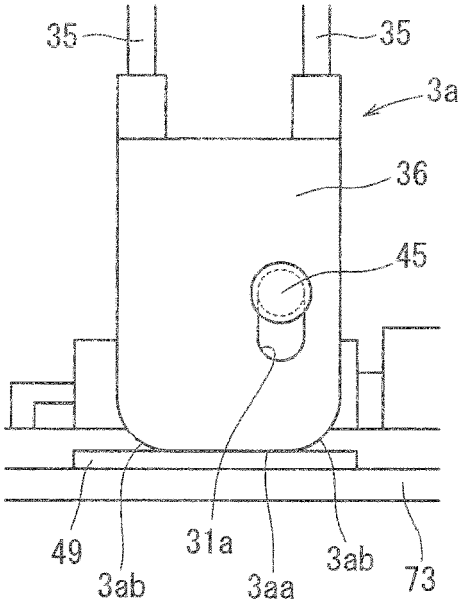
FIG. 4 is a schematic side view around a connecting hole provided at the fuel supply device of FIG. 1.
Figure 5:
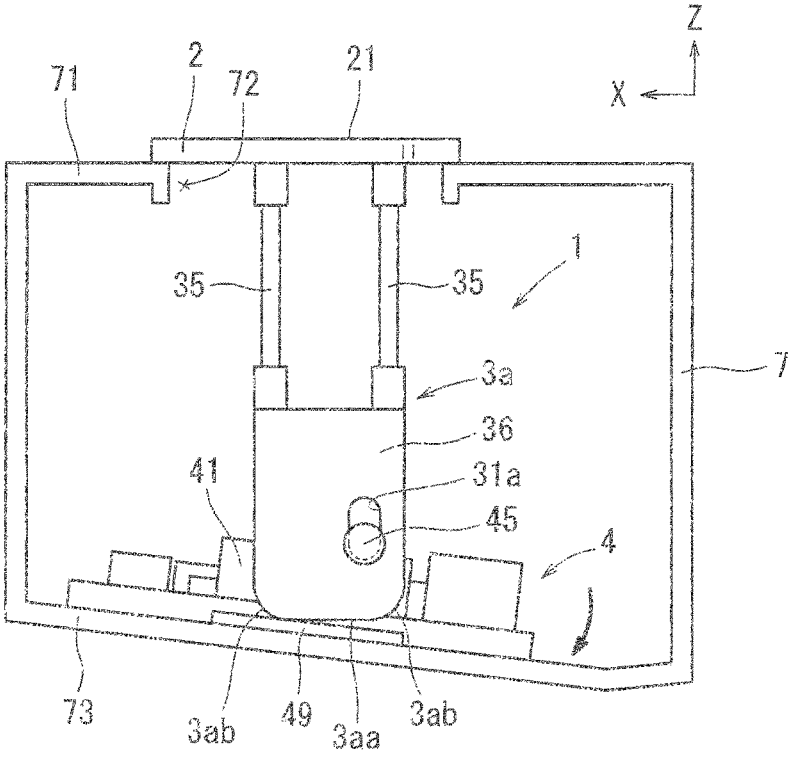
FIG. 5 is a schematic side view showing a relationship of the deformed fuel tank and the fuel supply device.

As shown in FIGS. 3 and 4, the terminal portion positioned at a lower end of the connecting portion 3*a* has a surface 3*aa* configured to be substantially parallel to the set plate portion 21. The surface is configured as a flat surface parallel to the XY plane, formed in a substantially rectangular shape. The rectangular surface 3*aa* abuts the top surface of the engagement portion 49 when the upper surface 71 and the bottom surface 73 of the fuel tank 7 are parallel. Curved surfaces 3*ab* are formed extending from both the forward and backward ends of the rectangular surface 3*aa*. The curved surfaces 3*ab* are configured in an arcuate shape as seen from a side view in the XZ plane. The curved surfaces 3*ab* normally do not abut the engagement portion 49, e.g. when the upper surface 71 and the bottom surface 73 of the fuel tank are parallel, and 3*aa* abuts the top surface of the engagement portion 49. However, as shown in FIGS. 5 and 6, the curved surfaces 3*ab* may abut the engagement portion 49 when the bottom surface 73 of the fuel tank 7 is deformed to be inclined.

As shown in FIGS. 3 and 4, an abutting area of the top surface of the engagement portion 49 and the lower terminal end of the connecting portion 3*a* can be ensured to be relatively large when the surface 3*aa* abutting the engagement portion 49 is a rectangular surface. As a result, the pump unit 4 can be firmly abutted to the bottom surface 73 of the fuel tank 7 when the fuel tank 7 is in a normal state i.e., not deformed.

An example of how the fuel supply device 1 behaves when the bottom surface 73 of the fuel tank 7 is deformed will be explained as follows. The fuel supply device 1 is usually maintained in a state attached to the fuel tank 7. The shape of the fuel tank 7 can be deformed due to the environment of its use, including impact with other vehicles or property, accidents, etc. Namely, such causes for the deformation of the fuel tank 7 are most likely to occur after the fuel supply device 1 is attached to the fuel tank 7, when the car is in operation, as opposed to other times. Hereinafter, a behavior of the fuel supply device 1 in this case will be briefly described.

According to the fuel supply device 1 as shown in FIGS. 3 and 4, in an ordinary circumstance, the pump unit 4 is pressed against the bottom surface 73 of the fuel tank 7. This is caused by the downwards biasing force exerted by the spring 53 which is positioned between the cover member 2 and the joint portion 36. When the tank is then deformed, because the bottom surface is now altered from the ordinary circumstance, the pump unit 4 rotates about the connecting shaft 45 since the biasing force is still being applied from the spring 53 to the pump unit 4 via engagement portion 49 when the bottom surface 73 of the fuel tank 7 is deformed as shown in FIG. 5. This may be achieved when the connecting shaft 45 moves from the position shown by a two-dot line in FIG. 6 to a position shown by a solid line.

As long as the deformation of the bottom surface 73 is caused within a predetermined range, the pump unit 4 continuously receives the biasing force from the spring 53. Therefore, with this continuous application of downwards biasing force, and the above described rotation, the pump unit 4 is maintained in an abutted state against the bottom surface 73 of the fuel tank 7. The predetermined range may be determined by an amount of movement of the connecting shaft 45 relative to the connecting hole 31*a*. Specifically, it may be determined by a longitudinal vertical length of a slide hole portion 311 of the connecting hole 31*a*. Therefore, with the abutment of the pump unit 4 to the bottom surface of the fuel tank 7 within the predetermined range of deformation, fuel supply device 1 may suck the fuel at the bottom of the fuel tank 7 through the suction port of the base portion 42 and to the pump 41 of the pump unit 4, and thus the fuel can be efficiently used even when the bottom surface 73 of the fuel tank 7 is deformed.

An embodiment shown in FIG. 7 is described as follows. As in the earlier embodiment, in the embodiment shown in FIG. 7, the pump unit 4 provided at the fuel supply device 1 can be maintained in an abutted state to the bottom surface 73 of the fuel tank 7 even when the bottom surface 73 of the fuel tank 7 is deformed to be inclined. According to the embodiment shown in FIGS. 1 to 6, this objective is achieved by the formation of the connecting hole 31*a* as an elongated hole. In contrast, according to the embodiment of FIG. 7, this objective can be achieved by configuring the lower terminal end of the connecting portion 3*b* to be of a specific shape. Therefore, a major difference between the embodiment of FIG. 7 and the prior embodiment as shown in FIGS. 1 to 6 is the configuration of the shape of the lower end of connecting portion 3*b* as well as the configuration of the connecting hole. Hereinafter, this difference will be mainly described.

The connecting hole 31*a* of the prior embodiment shown in FIG. 4 is an elongated hole, while the connecting hole 31*b* of the embodiment shown in FIG. 7 is not an elongated hole. Therefore, unlike the prior embodiment, in FIG. 7, the connecting shaft 45 is substantially vertically immobile upwards or downwards relative to the connecting hole 31*b*. The lower terminal end of the connecting portion 3*b*, which abuts the engagement portion 49, has a curved surface 3*ba* directly below, and surrounding, the connecting shaft 45. Namely, the curved surface 3*ba* may have a circular arc shape as seen from a side view where it is concentric with the center of the connecting hole 31*b*. More specifically, the lower terminal end of the connecting portion 3*b* is formed in a semicircular shape resembling the lower half of a circle, about the center of the connecting hole 31*b* as seen from a side view in the XL plane. If this configuration is seen in view of the relation of the lower terminal end of the connecting portion 3*b* with respect to the connecting shaft 45, a central axis of the semicircular portion which forms the lower terminal end of the connecting portion 3*b*, around which rotation may occur, substantially corresponds to an axial center R of the connecting shaft 45.

According to the fuel supply device 1 shown in FIG. 7, a relative angle of the abutment of the engagement portion 49 of the pump unit 4 and the lower terminal end of the connecting portion 3*b*, relative to the horizontal, may be changed while maintaining the abutted state. Furthermore, the range of followability of the pump unit 4, in which it may continue to receive biasing force from 53, in response to the deformation of the fuel tank 7, is increased because the rotation of the pump unit 4 in both directions is allowed from the state shown in FIG. 7 as denoted by the directional arrows (i.e., from the position where the set plate portion 21 and the pump unit 4 are arranged substantially parallel, with an angle of abutment of the engagement portion 49 of the pump unit 4 and the lower terminal end of the connecting portion 3*b* of about 0 degrees relative to the horizontal).

While the embodiments of disclosure have been described with reference to specific configurations, it will be apparent to those skilled in the art that many alternatives, modifications and variations may be made without departing from the scope of the present disclosure. Accordingly, embodiments of the present disclosure are intended to embrace all such alternatives, modifications and variations that may fall within the spirit and scope of the appended claims. Embodiments of the present disclosure should not be limited to the representative configurations, but may be modified, for example, as described below.

For example, the elongated hole (connecting hole 31*a*), instead of a linear vertically elongated hole as disclosed above, may have a linear shape as well as a bent shape such as a substantially L-shape, which is bent in the middle. The width of the elongated hole (connecting hole 31*a*) may be changed in the middle.

A circular arc portion (curved surface 3*ab*) shown in FIG. 4 is not necessarily provided at both ends of a pressing portion (the leading end comprising the lower terminal end of the connecting portion 3*a*). It may also be provided at only one of the ends, or may not be provided at all. If the circular arc portion is not provided at all, one part or an entire surface of the engagement portion 49 abutted to the connecting portion 3*a* may be configured in a circular arc shape as seen from a side view in the XZ plane.

The filter member is not necessarily arranged at the base portion. Therefore, it is also possible to configure the base portion without the filter member. In this case, the filter member may be arranged at any other portion than the base portion. In a further alteration, if the fuel to be sucked by the pump is maintained in a clean state, the filter member does not have to be present in the fuel supply device at all.

Moreover, as per the vehicle, the disclosure is not limited in scope to automobiles. It may also be used in a vehicle that flies in the air (e.g. an airplane or a helicopter), or that moves over the sea or in the sea (e.g. a ship or a submarine).

According to the embodiment in FIG. 3, the connecting shaft 45 is formed as part of the pump unit 4 and the connecting hole 31*a* is formed as part of the connecting portion 3*a*. Alternatively, the pump unit 4 may also be connected relatively movable with respect to the connecting portion 3*a* of the pump unit 4 by having the connecting shaft formed as part of the connecting portion 3 and the connecting hole formed as part of the pump unit so that the connecting shaft is inserted into the connecting hole.

The invention claimed is:

1. A fuel supply device comprising:

a cover member which is attached to an opening of a fuel tank;

a pump unit comprising a pump;

a connecting portion which connects the cover member and the pump unit;

a connecting shaft which is formed as part of one of the connecting portion or the pump unit; and a connecting hole which is formed as part of the connecting portion if the connecting shaft is formed as part of the pump unit or formed on the pump unit if the connecting shaft is formed as part of the connecting portion, in which the connecting shaft is inserted, such that the pump unit is connected through the insertion of the connecting shaft in the connecting hole so as to be movable relative to the connecting portion, wherein the connecting hole has an elongated hole portion that allows the connecting shaft to be relatively movable in the upward and downward directions, the pump unit is provided with an engagement portion which abuts an end of the connecting portion wherein the end portion is a lower terminal end of the connecting portion and is positioned below the connecting shaft when the fuel supply device is attached to the fuel tank, and movement of the connecting shaft in the upward and/or downward directions relative to the connecting hole allows the device to maintain the engagement portion and the lower terminal end of the connecting portion in an abutted state even when the fuel tank is deformed such that the pump unit is inclined with respect to the horizontal, relative to the connecting portion.

2. The fuel supply device of claim 1, wherein the lower terminal end of the connecting portion comprises a planar part which can abut on the engagement portion, as well as arcuate curved surface as seen from a side view, which extend from the planar part.

3. A fuel supply device comprising:

a cover member which is attached to an opening of a fuel tank;

a pump unit comprising a pump;

a connecting portion which connects the cover member and the pump unit;

a connecting shaft which is formed as part of one of the connecting portion or the pump unit; and a connecting hole which is formed as part of the connecting portion if the connecting shaft is formed as part of the pump unit or formed on the pump unit if the connecting shaft is formed as part of the connecting portion and in which the connecting shaft is inserted, such that the pump unit is connected through the insertion of the connecting shaft in the connecting hole so as to be movable relative to the connecting portion, wherein the pump unit is provided with an engagement portion which abuts an end of the connecting portion wherein the end is a lower terminal end of the connecting portion and is positioned below the connecting shaft when the fuel supply device is attached to the fuel tank, the end of the connecting portion has a circular arc curved surface positioned directly below the connecting shaft, the engagement portion comprises a substantially flat plate shape, and a bottom surface of the engagement portion is pressed against a bottom surface of the fuel tank when the fuel supply device is attached to the fuel tank.

4. The fuel supply device of claim 3, where the lower terminal end comprising the end of the connecting portion is formed as a curved surface in a semicircular shape, wherein the semicircular shape as seen from a side view in an XZ plane is concentric with a center of the connecting hole, wherein a central axis of the semicircular shape around which rotation occurs, substantially corresponds to an axial center of the connecting shaft.

5. The fuel supply device of claim 1, wherein the cover member comprises a set plate portion radially extending in a plane parallel to an XY plane, and where the connecting hole is formed such that the connecting shaft can move vertically as seen from an XZ plane, in a direction substantially orthogonal to a plane in which the set plate portion radially extends, wherein the connecting hole includes a slide hole portion in which the connecting shaft slides vertically in response to tank deformation, wherein the connecting hole also has a connecting shaft insertion portion separate from the slide hole portion to allow a leading end of the connecting shaft to be inserted, and wherein an engagement piece is provided within said connecting shaft insertion portion, and is elastically deformed when pressed from one direction not orthogonal to said one direction, to prevent the connecting shaft from being removed from the connecting hole.

6. The fuel supply device of claim 1, wherein the cover member comprises a set plate portion radially extending in a plane parallel to an XY plane, and where the connecting hole is formed in an L-shape bent in the middle, wherein the connecting hole includes a slide hole portion in which the connecting shaft slides vertically in response to tank deformation as seen in an XZ plane, wherein the connecting hole also has a connecting shaft insertion portion separate from the slide hole portion to allow a leading end of the connecting shaft to be inserted, and wherein an engagement piece is provided within said connecting shaft insertion portion, and is elastically deformed when pressed from one direction not orthogonal to said one direction to prevent the connecting shaft from being removed from the connecting hole.

7. The fuel supply device of claim 1, wherein the lower terminal end comprising the end of the connecting portion comprises a planar part parallel to an XY plane to abut on the engagement portion with no arcuate curved surfaces extending from a forward and a backward end of the planar part.

8. The fuel supply device of claim 7, wherein one part of the engagement portion abutting the lower terminal end of the connecting portion is configured in a circular arc shape as seen from a side view in an XZ plane.

9. The fuel supply device of claim 7, wherein an entire top surface of the engagement portion abutting the lower terminal end of the connecting portion is configured in a circular arc shape as seen from a side view in an XZ plane.

10. A fuel supply device comprising:

a cover member comprising a circular set plate portion radially extending in an XY plane, which is mounted to and covers an opening of a fuel tank;

a pump unit comprising a pump and a base portion, wherein the base portion comprises a suction port;

a telescopic connecting portion comprising a plurality of rod members extending orthogonal to a plane in which the set plate portion radially extends, a spring that can exert elastic force, and a joint portion, wherein the spring is fitted around one of the rod members, vertically arranged between the cover member and the joint portion which connects the cover member and the pump unit;

a connecting shaft which is formed as part of one of the connecting portion or the pump unit; and a connecting hole which is formed as part of the connecting portion if the connecting shaft is formed on the pump unit or formed on the pump unit if the connecting shaft is formed on the connecting portion and in which the connecting shaft is inserted, such that the pump unit is connected through the insertion of the connecting shaft in the connecting hole so as to be movable relative to the connecting portion, wherein the pump unit is provided with an engagement portion which abuts an end of the connecting portion wherein the end is a lower terminal end of the connection portion and is positioned below the connection shaft, when the fuel supply device is attached to the fuel tank, wherein the engagement portion comprises a substantially flat plate shape parallel to the XY plane, where a bottom surface of the lower terminal end of the connecting portion abuts a top surface of the engagement portion, and the spring biases the cover member to move away from the pump unit whenever the cover member and pump unit mutually approach closer than a predetermined distance, and wherein when the device is mounted to the fuel tank, the pump unit is touching a bottom surface portion of the fuel tank and the spring is compressed, where biasing force from the compression of the spring is transmitted downward from the connecting portion to the engagement portion which abuts the lower terminal end of the connecting portion, and presses the engagement portion downwards flush against the bottom surface portion of the fuel tank when the fuel supply device is attached to the fuel tank through force.

11. The fuel supply device of claim 10, wherein the lower terminal end comprising the end of the connecting portion comprises a planar part parallel to the XY plane which abuts the engagement portion and arcuate curved surfaces, as seen from a side view in the XZ plane, which extend from the forward and backward ends of the planar part as seen from a side view in an XZ plane, where the connecting hole has a linear vertically elongated hole portion that allows the connecting shaft to be relatively movable in the upward and downward directions, and movement of the connecting shaft in the upward and/or downward directions relative to the connecting hole allows the device to maintain the engagement portion and the lower terminal end of the connection portion in an abutted state even when the fuel tank is deformed, wherein the biasing force is applied from the spring to the pump unit via the engaging portion such that the pump unit rotates about the connecting shaft when the bottom surface of the fuel tank is deformed, such that the pump unit is inclined with respect to the horizontal, relative to the connecting portion, where through said abutted state the fuel supply device may continue to suck fuel at the bottom of the fuel tank through the suction port of the base portion to the pump of the pump unit.

12. The fuel supply device of claim 10, wherein the lower terminal end comprising the end of the connecting portion is formed as a curved surface in a semicircular shape, wherein the circular arc shape as seen from a side view in an XZ plane is concentric with a center of the connecting hole, which is also circular and not elongated, wherein a central axis of the semicircular shape around which rotation occurs, substantially corresponds to an axial center of the connecting shaft, wherein the device maintains the engagement portion and the lower terminal end of the connection portion in an abutted state even when the fuel tank is deformed, such that the engagement portion lies at a tangent to the semicircular shape of the lower terminal end, where the relative angle of an abutment of the engagement portion and the lower terminal end of the connecting portion relative to a horizontal X axis may be changed while still maintaining the abutted state, wherein the biasing force is applied from the spring to the pump unit via the engaging portion such that the pump unit rotates about the connecting shaft when the bottom surface of the fuel tank is deformed, such that the pump unit is inclined with respect to the horizontal, relative to the connecting portion, where through said abutted state the fuel device may continue to suck fuel at the bottom of the fuel tank through the suction port of the base portion to the pump of the pump unit.

* * * * *